United States Patent [19]

Colamussi

[11] Patent Number: 5,056,193

[45] Date of Patent: Oct. 15, 1991

[54] NON-HANDED SHOCK ARRESTOR DOOR PIVOT

[75] Inventor: Dominic J. Colamussi, Kensington, Conn.

[73] Assignee: The Stanley Works, New Britain, Conn.

[21] Appl. No.: 634,059

[22] Filed: Dec. 26, 1990

[51] Int. Cl.[5] ..... E05D 7/10; E05D 5/06

[52] U.S. Cl. ..... 16/262; 16/381; 16/392

[58] Field of Search ..... 16/262, 381, 389, 392

[56] References Cited

U.S. PATENT DOCUMENTS

| | | |
|---|---|---|
| 1,865,339 | 6/1932 | Schilling . |
| 2,290,035 | 7/1942 | Conwell . |
| 2,312,029 | 2/1943 | Conwell . |
| 3,469,276 | 9/1969 | Dickson . |
| 3,561,038 | 2/1971 | Bennett . |
| 3,874,027 | 4/1975 | Parsons . |
| 4,228,561 | 10/1980 | Gwozdz . |
| 4,774,740 | 10/1988 | Gidseg et al. . |

OTHER PUBLICATIONS

Ken Watson Enterprises Ltd., Sales Brochure, "Markar Products Reinforcing Pivot Hinge".

Stanley Hardware advertising sheet on "Shock Pivots", #H771, 4/75.

*Primary Examiner*—Robert L. Spruill

*Assistant Examiner*—Carmine Cuda

[57] ABSTRACT

A non-handed shock arrestor is provided for pivotally mounted doors, and it includes a frame member with a pivot plate portion with pivot apertures adjacent either end thereof, and it is disposed horizontally on the door frame with one of its pivot apertures aligned with the hinge pins. The frame member also has a mounting portion extending perpendicularly to the pivot plate portion with apertures therein seating fasteners which secure the frame member to the face of the door frame. The arrestor also includes a door member with a pivot plate portion with pivot apertures adjacent either end thereof aligned with those of the frame member, and disposed horizontally of the door. It extends over the hinges. The door member also has a mounting portion intermediate the ends of the pivot plate portion extending perpendicularly thereto, and having apertures therein seating fasteners securing the door member to the face of the door. A pivot member is seated in an aligned pair of the pivot apertures to provide a pivotal connection between the frame and door members, and it is aligned with the pivot axis of the hinges of the door assembly. The pivot member is also mountable in the other of the aligned pair of pivot apertures for a door of the opposite hand.

12 Claims, 3 Drawing Sheets

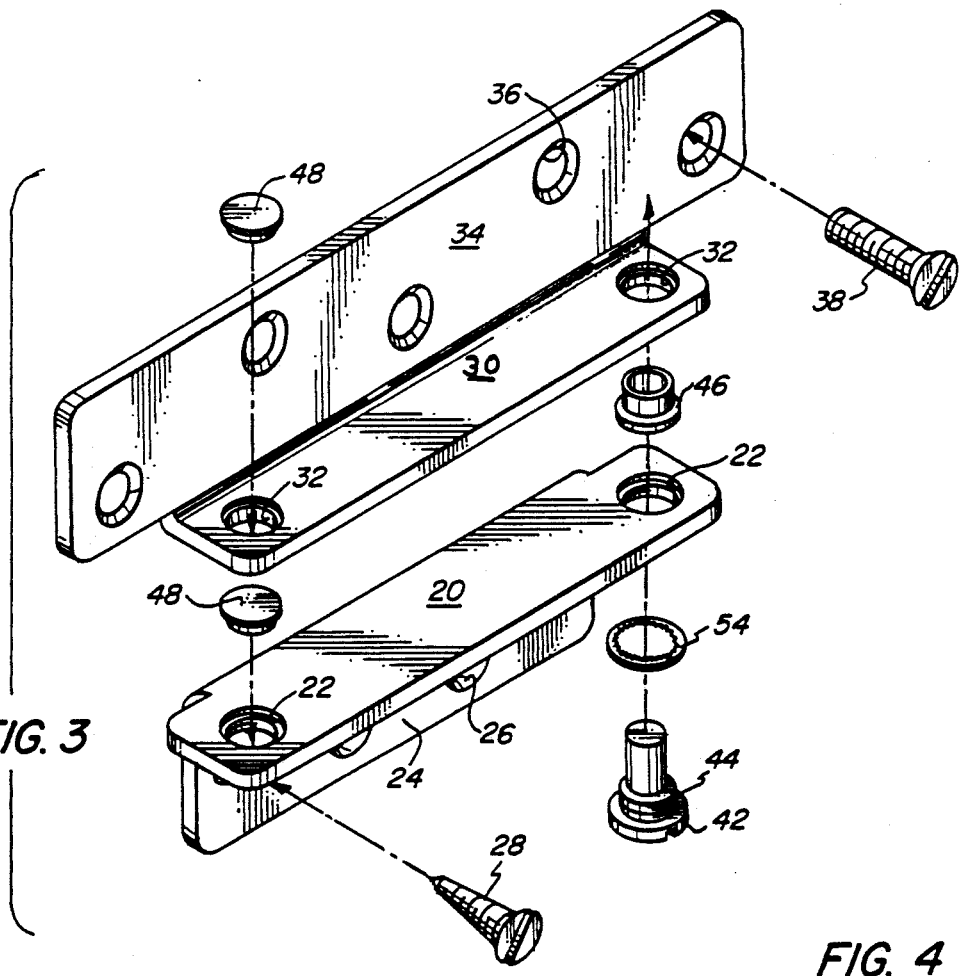
FIG. 3
FIG. 4
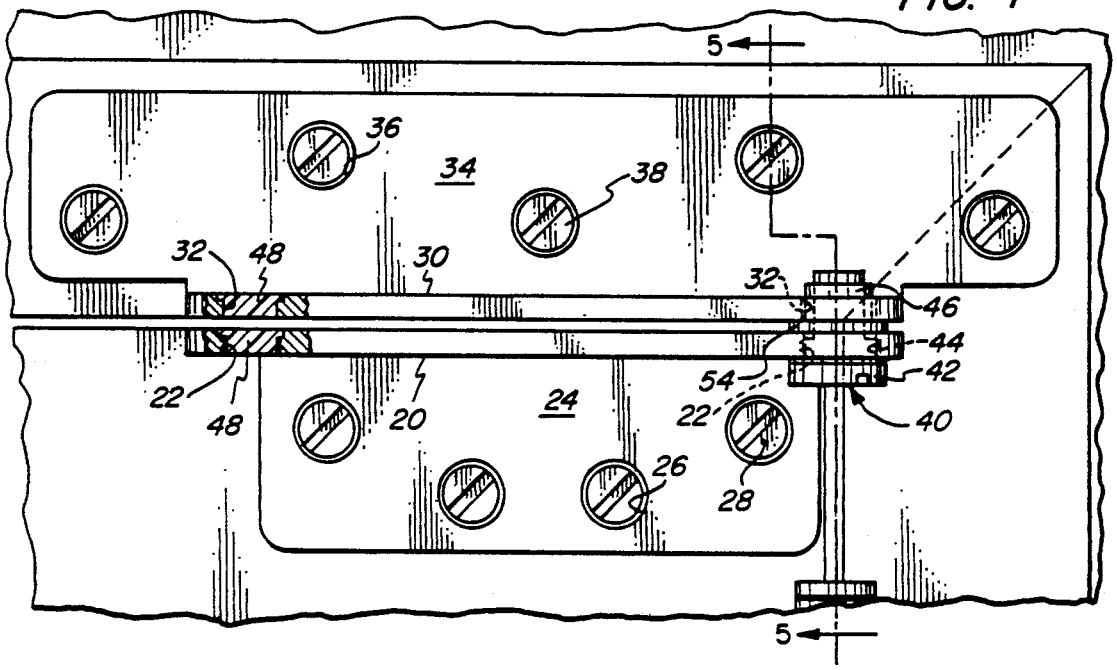

NON-HANDED SHOCK ARRESTOR DOOR PIVOT

BACKGROUND OF THE INVENTION

The present invention relates to door assemblies, and more particularly, to a shock arresting pivot assembly for hinge doors.

As is well known, pivoting of a door to a full open position can produce substantial shear loading or wracking forces on the door and on the hinges. This condition is particularly pronounced when the door is one which is frequently opened and closed and subjected to substantial opening forces tending to drive it to the full open position of the hinges which stop further movement in the opening direction. It is also pronounced when relatively heavy doors are abruptly stopped in their opening movement by door stops and door closers. If such stops or closers are mounted at the top of the door along its width, they can provide a point about which the upper end of the door attempts to pivot as a result of the opening forces to place great stress upon the hinges and their mounting to the door and jamb.

To alleviate the wracking forces on the door assembly, shock arrestor pivot assemblies have been employed and mounted along the upper edge of the door to assist in withstanding the stresses by arresting the shear loading on the door and spread the wracking forces over a relatively large area of the face of the door and of the jamb adjacent thereto. Such shock arrestors have enjoyed considerable acceptance in commercial, industrial and residential applications, and are exemplified by those illustrated in Parsons U.S. Pat. No. 3,874,027 and Bennett U.S. Pat. No. 3,561,038.

Because doors may be mounted along either side thereof depending upon the intended installation, the configuration of prior arrestors has generally required the stocking of left and right hand versions. As a result, if the stock of either version should be exhausted, an arrestor cannot be immediately installed. Moreover, with respect to an existing arrestor installation, if it should be desired to change the hand of the door, it would be necessary to obtain a new door arresting assembly.

Accordingly, it is an object of the present invention to provide a novel shock arresting door pivot which is adapted for use in both left and right handed door installations.

It is also an object to provide such a door pivot which may be readily fabricated from durable components to provide a long-lived assembly.

Another object is to provide such pivot assembly which may be readily assembled to the door and adjacent frame, and which may be readily moved from a position along one side of the door to a position along the other side of the door in the event that it is desired to change the hand or opening direction of the door.

SUMMARY OF THE INVENTION

It has now been found that the foregoing and related objects may be readily attained in a non-handed shock arrestor for use with pivotally mounted doors, and it includes a frame member having a pivot plate portion with pivot apertures adjacent either end thereof and adapted to be disposed horizontally on the door frame in a position extending over the hinge pins. The frame member also has a mounting portion extending perpendicularly to the pivot plate portion and having apertures therein for seating fasteners to secure the frame member to the face of the door frame above the hinges.

The arrestor also includes a door member having a pivot plate portion with pivot apertures adjacent either end thereof cooperatively spaced for alignment with the pivot apertures of the frame member and adapted to be disposed horizontally of the associated door and extending over the hinges of the associated door. The door member has a mounting portion intermediate the ends of the pivot plate portion and extending perpendicularly thereto, and it has apertures therein for seating fasteners to secure the door member to the face of the door. A pivot member is seated in an aligned pair of pivot apertures to provide a pivotal connection between the frame and door members and it is aligned with the pivot axis of the hinges of the door. The pivot member is also mountable in the other of the aligned pair of pivot apertures for a door of the opposite hand.

Preferably, the frame member is of generally L-shaped cross section and the mounting portion thereof has end portions extending beyond both ends of the pivot plate portion. The door member is also of generally L-shaped cross section and the pivot plate portion thereof has end portions extending beyond both ends of the mounting portion thereof.

Desirably, the pivot member includes a bushing seated in one of the pivot plate portions and a pivot pin seated in the other pivot plate portion, and it is rotatable in the bushing. The pivot pin has a threaded shank threadably engaged in the other plate portion. A pair of plugs is removably seated in the other pair of pivot apertures.

BRIEF DESCRIPTION OF THE DRAWINGS

FIG. 3 is an exploded view of the shock arrestor door pivot;

FIG. 4 is a fragmentary front elevational view of the door installation with a portion of the door pivot shown in section;

DETAILED DESCRIPTION OF THE ILLUSTRATED EMBODIMENT

Figure 1:
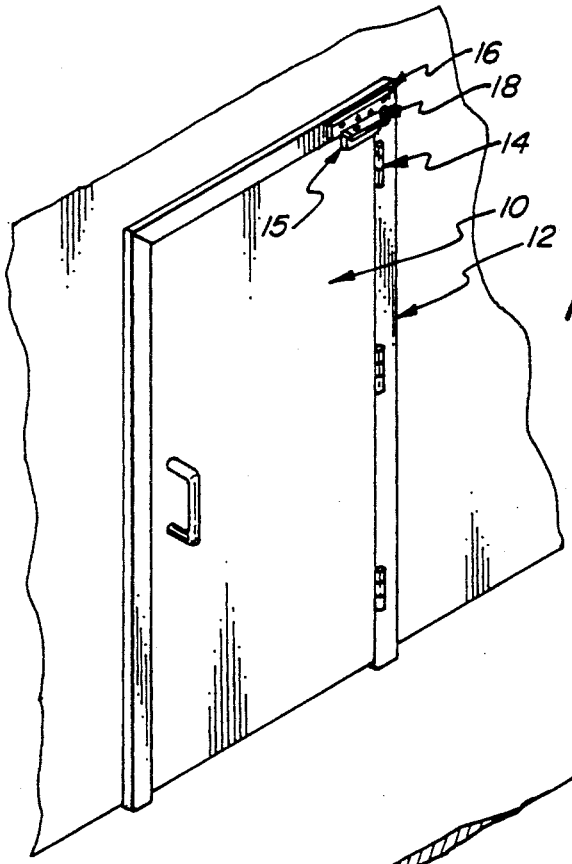
FIG. 1 is a fragmentary view of a wall in which there is a door installation employing the shock arrestor door pivot of the present invention.
Figure 2:
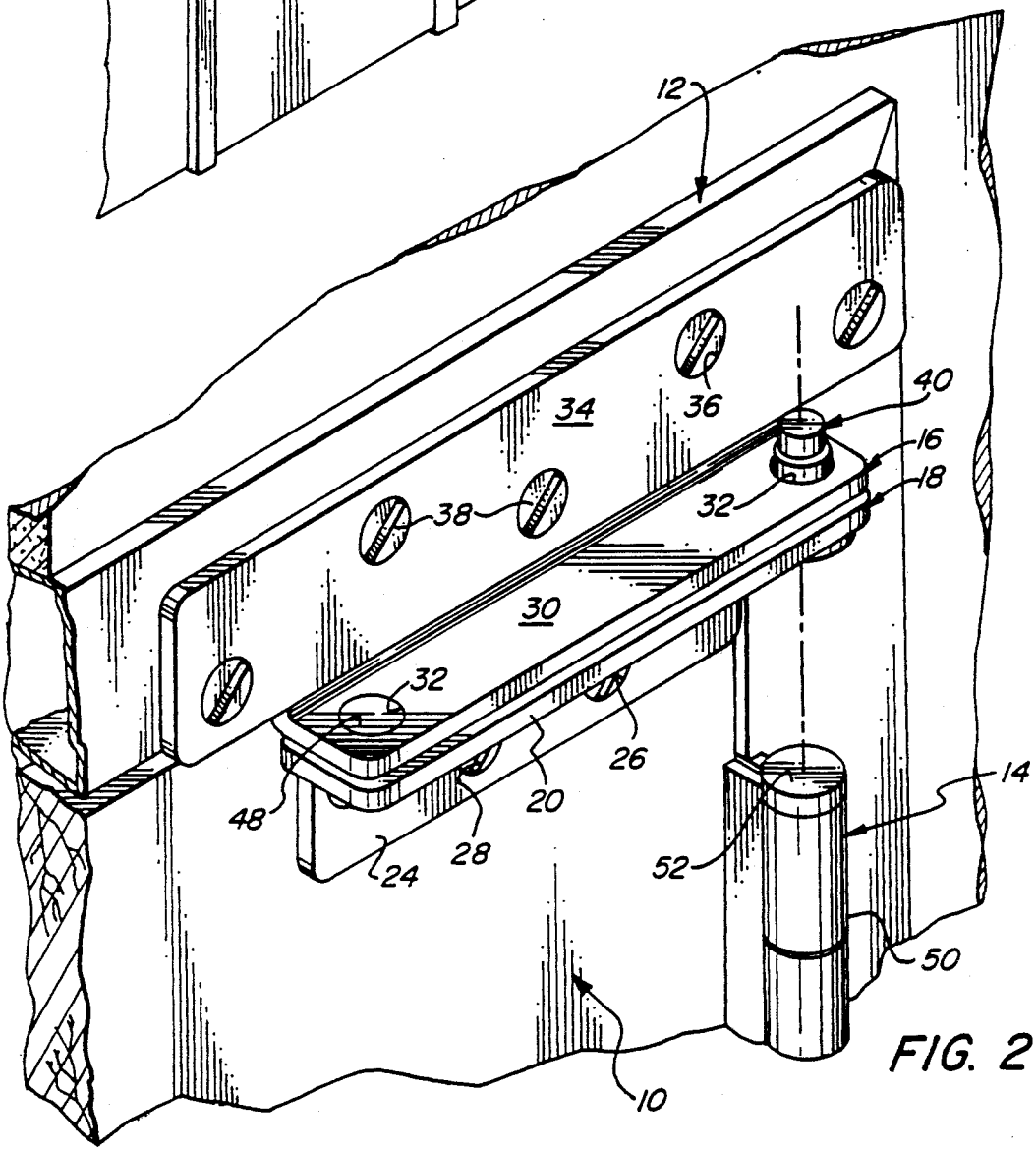
FIG. 2 is an enlarged fragmentary view of the arrestor door pivot portion of the installation with a portion of the wall and door frame in section.

Turning first to FIG. 1, therein illustrated is a typical installation embodying the present invention wherein a door generally designated by the numeral 10 is pivotally mounted upon the frame generally designated by the numeral 12 by a multiplicity of hinges 14 along the right hand side thereof. Mounted on the upper edge of the door 10 and the adjacent portion of the frame 12 is a shock arrestor door pivot embodying the present invention and generally designated by the numeral 15.

As seen in FIGS. 2–5, the door pivot 15 of the present invention includes a frame member generally designated by the numeral 16 which is mounted upon the door frame 12 and a door member generally designated by the numeral 18 which is mounted along the upper edge of the door 10. The door member 18 has a horizontally disposed elongated pivot plate portion 20 having a pair of apertures 22 adjacent its ends, and a vertically disposed mounting portion 24 having four apertures 26 therein in which are seated fasteners 28 for securing the door member 18 to the face of the door 10. As will be appreciated, the pivot plate portion 20 is of greater length than the mounting portion 24 so that it extends beyond the side margins thereof to permit disposition of the apertures 22 in coaxial alignment with the hinge pins 52 in the barrels 50 of the hinges 14.

The frame member 16 also has an elongated horizontally disposed pivot plate portion 30 with apertures 32 adjacent its ends which are aligned with the apertures 22, and a vertically disposed mounting portion 34 with apertures 36 which seat fasteners 38 to mount the frame member 16 upon the face of the door frame 12. The mounting portion 34 is of greater length than the pivot plate portion 30 so that its ends will extend well beyond the barrels 50 of the hinges 14 and thereby transfers some of the stresses to the vertically extending portion of the door frame 12.

In the installation seen in FIGS. 1-5, the door 10 is mounted for pivoting about its right hand side, and there is seated in the right hand pair of aligned apertures 22 and 32 over the hinges 14, the pivot assembly generally designated by the numeral 40. As seen, this comprises a pivot pin 42 with a relatively large diameter head and an elongated shank with a threaded portion 44. As seen, the head is disposed below the pivot plate portion 20 of the door member 18 and is threaded into the aperture 22 to secure it in position and resist relative movement during normal operation of the door pivot. A lock washer 54 is provided on the shank below the pivot plate portion 20. The shank continues upwardly through the bushing 46 which is disposed in the aperture 32 of the pivot plate portion 30 of the frame member 16. As a result, during opening and closing motion of the door, the pivot pin 42 will freely rotate within the bushing 46.

Disposed in the other aligned pair of apertures 22,32 are synthetic resin plugs 48.

In mounting the door pivot of the present invention, the assembled members 16,18 are located in a position of axial alignment with the hinge pins 52 of the hinges 14 and their positions are marked upon the door 10 and frame 12. The members 16,18 are then fastened securely to the frame 12 and door 10 respectively by the fasteners 38 and 28.

Figure 5:
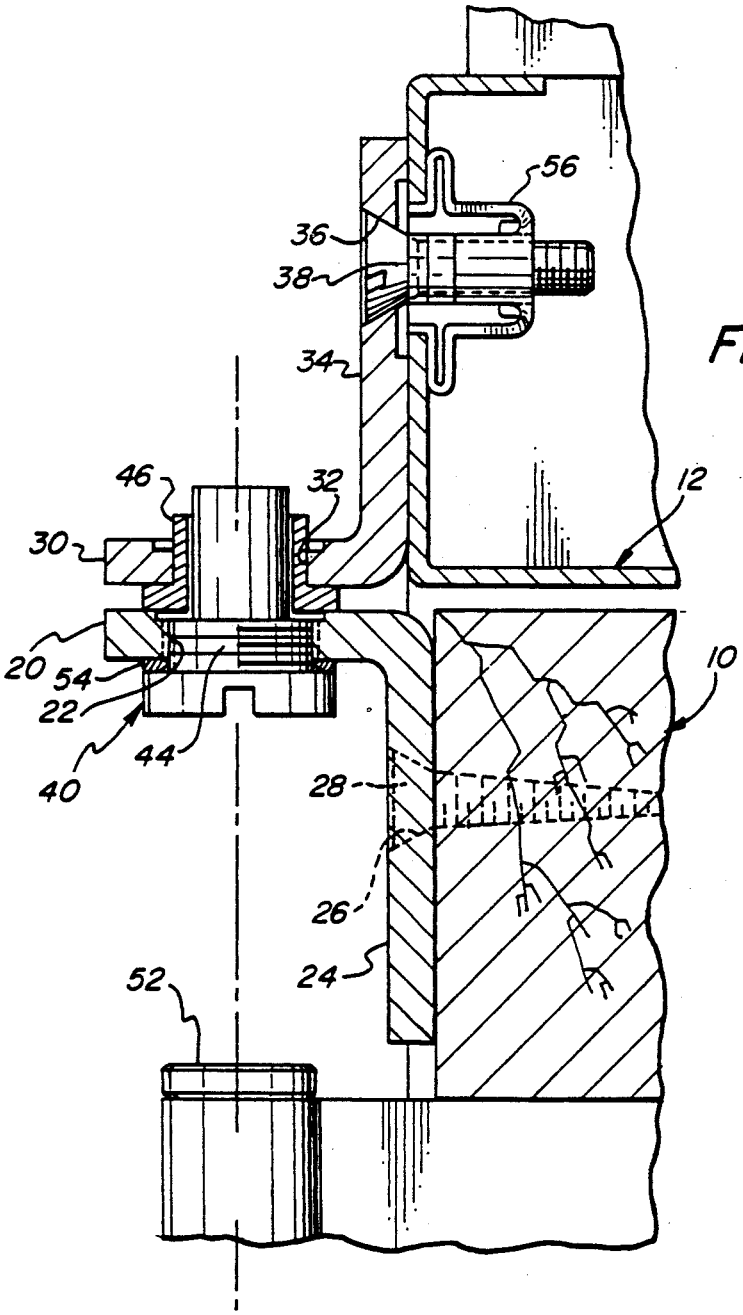
FIG. 5 is a fragmentary cross sectional view of the installation to a greatly enlarged scale along the line 5—5 of FIG. 4.

As seen in FIG. 5, the elements of the door pivot are normally configured and dimensioned to accommodate an inset of the door 10 within the frame 12 of approximately ⅛ inch. If the face of the door is flush with the frame 12, this would require shimming the frame member 16. If the door inset is of a greater distance, this may require shimming of the door member 18.

In the illustration of FIG. 5, it can be seen that the door 10 is of wooden construction and the fasteners 28 are wood screws which seat in the wood of the door 10. The frame 12 is shown as of hollow metallic construction, and expanding nuts 56 are inserted into aperture in the frame 12 to seat and lock the machine screws 38.

Figure 6:
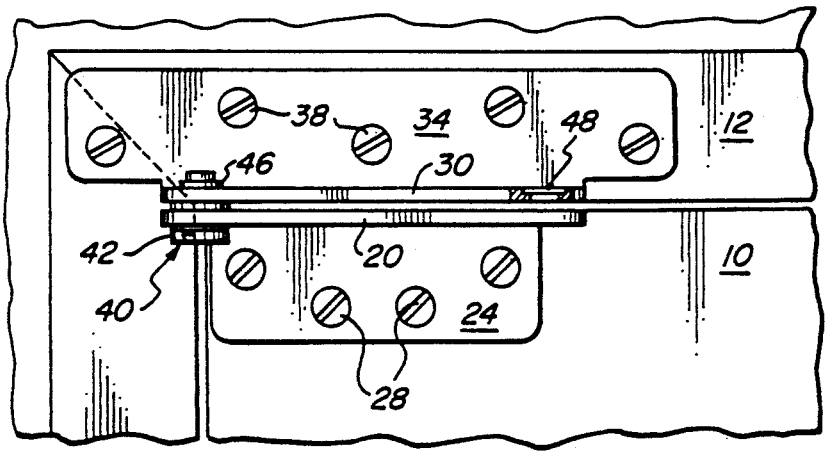
FIG. 6 is a view similar to FIG. 4 with the door pivot moved from the right hand side of the frame in FIG. 4 to the left side seen in FIG. 6 to accommodate a right handed door mounting.

Turning now to FIG. 6, the arrestor door pivot of the present invention may also be utilized for a right handed door installation as seen therein. In this instance, the apertures 22,32 of the door and frame members 18,16 respectively are aligned with the hinges 14 now disposed along the left hand side of the door 10. The plugs 48 are inserted into the right hand set of apertures 22,32.

As will be readily appreciated, the shock arresting door pivot of the present invention does not interfere with the normal opening and closing movement of the door. However, it does maintain the relatively precise positioning of the upper edge of the door relative to the frame against wracking forces which occur when the door is opened fully against the hinges. Any tendency for the axial alignment to be displaced in any direction radially about the hinge line will be resisted by the pivot pin within the pivot plate portions of the door pivot. The forces on the pivot pin are transferred through the frame and door members which transfer those forces over a substantial length of the frame and door. As a result, the wracking forces are readily resisted, and there is a greatly reduced tendency to adversely effect the fastenings of the hinges to the door and to the frame, or to split wooden door stiles.

As will be readily appreciated, the elements of the door pivot are relatively simply fabricated from durable materials. The frame and door members are made of heavy-gauge metal to withstand and transfer the forces imparted thereto. The pivot pin may be fabricated from metal or synthetic resin, and the same is true with respect to the bushing. The configuration and size may vary from that specifically illustrated in the drawings of the present application so long as the basic requirements of aligned apertures at either end of the horizontal pivot portions is maintained to permit the reversal for mounting on either side of the door.

Thus, it can be seen from the foregoing detailed specification and the attached drawings, that the shock arrestor door pivot of the present invention is one which may be readily fabricated from materials which will provide long-lived structure, and the components may be readily assembled and mounted upon the door and frame. The door pivot may be mounted on either side of the door to accommodate left handed or right handed door operation while still providing an attractive structure.

Having thus described the invention, what is claimed is:

1. A non-handed shock arrestor for use with pivotally mounted doors comprising:

(a) an elongated frame member having a pivot plate portion with pivot apertures, one of said apertures being adjacent either each thereof said pivot plate portion adapted to be disposed horizontally on the associated door frame in a position extending over the hinges mounting the associated door thereon, and a mounting portion extending perpendicularly to said pivot plate portion and having apertures therein for seating fasteners to secure said frame member to the face of the associated door frame above the hinges;

an elongated door member having a pivot plate portion with pivot apertures, one of said apertures being adjacent each end thereof, said apertures being cooperatively spaced for alignment with said pivot apertures of said member member said plate portion being adapted to be disposed horizontally at the upper edge of the associated door in a position extending over the hinges, and a mounting portion intermediate the ends of said pivot plate portion extending perpendicularly thereto, and having apertures therein for seating fasteners to secure said door member to the face of the door; and (c) a pivot member in an aligned pair of said pivot apertures to provide a pivotal connection between said frame and door members and alignable with the pivot axis of the associated hinges of the door assembly, said pivot member being mountable in the other of said aligned pair of pivot apertures for a door of the opposite hand.

2. The shock arrestor in accordance with claim 1 wherein said frame member is of generally L-shaped cross section with end portions on said mounting portion thereof extending beyond both ends of said pivot plate portion.

3. The shock arrestor in accordance with claim 1 wherein said door member is of generally L-shaped cross section and said pivot plate portion thereof has end portions extending beyond both ends of said mounting portion thereof.

4. The shock arrestor in accordance with claim 1 wherein said pivot member includes a bushing seated in said aligned aperture of one of said pivot plate portions and a pivot pin seated in said aligned aperture in the other of said pivot plate portions and rotatable in said bushing.

5. The shock arrestor in accordance with claim 4 wherein said pivot pin has a threaded shank threadably engaged in said other pivot plate portion.

6. The shock arrestor in accordance with claim 1 wherein a pair of plugs are removably seated in the other aligned pair of pivot apertures.

7. In a door assembly including a door frame, a door disposed therebetween, and a multiplicity of hinges pivotably mounting said door on said frame with the hinge barrels disposed outwardly of said frame and door, the combination therewith of a non-handed shock arrestor assembly comprising:

(a) an elongated frame member having a pivot plate portion disposed horizontally on said door frame extending over said hinge and with a pivot aperture adjacent each end thereof, one a pivot aperture being disposed in alignment with said hinge barrels, said frame member having a mounting portion extending perpendicularly to said pivot plate portion and against said frame, said mounting portion having apertures therein seating fasteners securing said frame member to said face of said door frame;

(b) an elongated door member including a pivot plate portion with a pivot aperture adjacent each end thereof in alignment below said pivot apertures of said frame member, said pivot plate portion being disposed horizontally on said door and extending over said hinges, said door member having a mounting portion intermediate the ends of said pivot plate portion extending perpendicularly thereto against the face of said door, said mounting portion having apertures therein seating fasteners securing said door member to said face of said door; an (c) a pivot member in a pair of said pivot apertures aligned with said hinge barrels to provide a pivotal connection between said frame and door members aligned with the pivot axis of said hinges, said pivot member being mountable in the other of said aligned pair of pivot apertures for a door of the opposite hand.

8. The door assembly in accordance with claim 7 wherein said frame member is of generally L-shaped cross section with end portions on said mounting portion thereof extending beyond both ends of said pivot plate portion.

9. The door assembly in accordance with claim 7 wherein said door member is of generally L-shaped cross section and said pivot plate portion thereof having end portions extending beyond both ends of said mounting portion thereof.

10. The door assembly in accordance with claim 7 wherein said pivot member includes a bushing seated in said aperture of one of said pivot plate portions and a pivot pin seated in said aperture of the other of said pivot plate portions and rotatable in said bushing.

11. The door assembly in accordance with claim 10 wherein said pivot pin has a threaded shank threadably engaged in said other pivot plate portion.

12. The door assembly in accordance with claim 7 wherein a pair of plugs are removably seated in the other aligned pair of pivot apertures.

* * * * *

UNITED STATES PATENT AND TRADEMARK OFFICE

CERTIFICATE OF CORRECTION

PATENT NO. : 5,056,193

DATED : October 15, 1991

INVENTOR(S) : Dominic J. Colamussi

It is certified that error appears in the above-identified patent and that said Letters Patent is hereby corrected as shown below:

Column 4, line 49, please delete "either"; same line, after "each", please insert --end--.

Column 4, line 62, please delete "member", first occurence and insert --frame--.

Signed and Sealed this

Twenty-third Day of March, 1993

*Attest:*

STEPHEN G. KUNIN

*Attesting Officer*

*Acting Commissioner of Patents and Trademarks*